US005622193A

United States Patent [19]

Pekarik

[11] Patent Number: 5,622,193

[45] Date of Patent: Apr. 22, 1997

[54] SELF HOLDING HAIR CURLER APPARATUS

[76] Inventor: Randall J. Pekarik, 201 Oakwood Dr., Geneva, Ill. 60132

[21] Appl. No.: 564,485

[22] Filed: Nov. 29, 1995

[51] Int. Cl.[6] ..... A45D 2/14

[52] U.S. Cl. ..... 132/254; 132/262; 132/265

[58] Field of Search ..... 132/245, 254, 132/253, 262, 265

[56] References Cited

U.S. PATENT DOCUMENTS

| | | | |
|---|---|---|---|
| 3,161,202 | 12/1964 | Mecca | 132/254 |
| 3,205,901 | 9/1965 | Moore | 132/254 |
| 3,334,638 | 8/1967 | Behrens | 132/262 |
| 4,215,710 | 8/1980 | Sundin | 132/254 |

FOREIGN PATENT DOCUMENTS

| | | | |
|---|---|---|---|
| 1457378 | 3/1969 | Germany | 132/245 |

*Primary Examiner*—Todd E. Manahan

[57] ABSTRACT

A self holding hair curler apparatus includes a first structure that has an interior threaded portion at a first end and an exterior surface area with a plurality of flexible spike-like projections. Included is a second structure that has an interior tube with an end cap at one end and is integral with the second structure at one end. The second structure has an inner surface and a chamber formed between the inner surface and the interior tube. The second structure has a plurality of rigid spike-like projections with adjacent slots along an outer surface thereof. Lastly, the second structure is capable of receiving the first structure within the chamber, while the flexible spike-like projections extend through the slots for movement to pinch strands of hair positioned about the second structure.

7 Claims, 3 Drawing Sheets

FIG 1
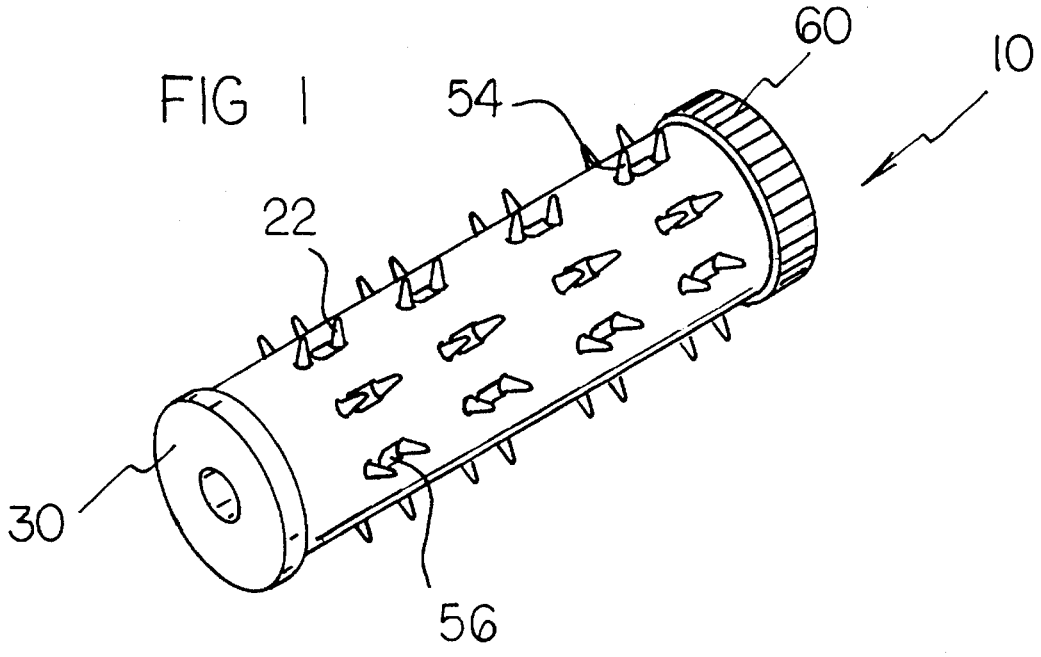
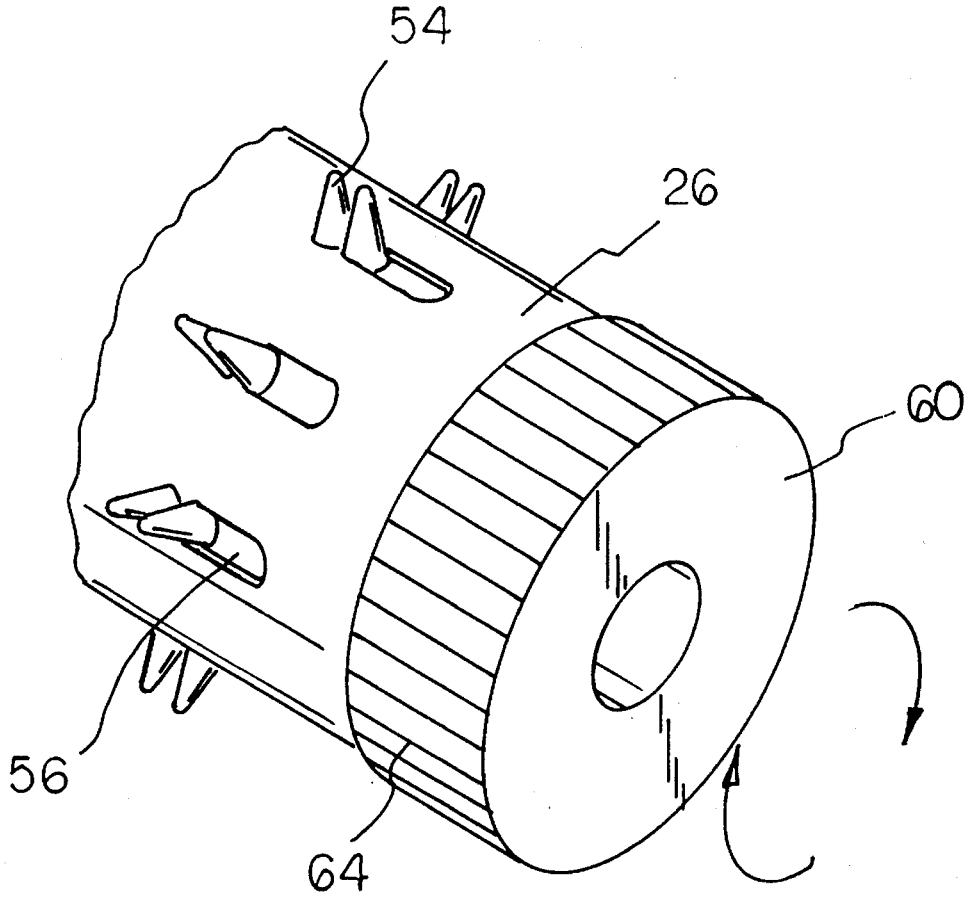
FIG 2

SELF HOLDING HAIR CURLER APPARATUS

BACKGROUND OF THE INVENTION

1. Field of the Invention

The present invention relates to a self holding hair curler apparatus and more particularly pertains to an improved hair roller that has spike-like projections that extend therefrom, and further the spike-like projections are capable of pinching the hair to hold the invention in place.

2. Description of the Prior Art

The use of hair rollers is known in the prior art. More specifically, hair rollers heretofore devised and utilized for the purpose of curling hair are known to consist basically of familiar, expected, and obvious structural configurations, notwithstanding the myriad of designs encompassed by the crowded prior art which has been developed for the fulfillment of countless objectives and requirements.

By way of example, U.S. Patent Des. 345,626 to Izzo discloses a hair curler. U.S. Pat. No. 5,000,201 to Barradas discloses a hair curler roller. U.S. Pat. No. 4,884,583 to Long, Jr. discloses a hair roller and rotating apparatus. U.S. Pat. No. 4,561,455 to Pajak discloses a pivoted handle hair curler having self-adjusting clamp. U.S. Pat. No. 4,533,818 to Green discloses an electric hair curler with self-contained battery power supply. U.S. Pat. No. 4,097,718 to Weise discloses a device for heat treating hair on the human head, and the like curling device having self-regulating PTC heater. Lastly, U.S. Pat. No. 4,020,855 to Phelps discloses a hair curler having integral retainer.

While these devices fulfill their respective, particular objectives and requirements, the aforementioned patents do not describe self holding hair curler apparatus that allows strands of hair to be rolled about the present invention, with the invention being held in place by a plurality of spike-like projections that are movable and capable of pinching strands of hair.

In this respect, the self holding hair curler apparatus according to the present invention substantially departs from the conventional concepts and designs of the prior art, and in doing so provides an apparatus primarily developed for the purpose of an improved hair roller that has spike-like projections that extend therefrom, and further the spike-like projections are capable of pinching the hair to hold the invention in place.

Therefore, it can be appreciated that there exists a continuing need for a new and improved self holding hair curler apparatus which can be used for an improved hair roller that has spike-like projections that extend therefrom, and further the spike-like projections are capable of pinching the hair to hold the invention in place. In this regard, the present invention substantially fulfills this need.

SUMMARY OF THE INVENTION

In view of the foregoing disadvantages inherent in the known types of hair rollers now present in the prior art, the present invention provides an improved self holding hair curler apparatus. As such, the general purpose of the present invention, which will be described subsequently in greater detail, is to provide a new and improved self holding hair curler apparatus and method which has all the advantages of the prior art and none of the disadvantages.

To attain this, the present invention essentially comprises a first cylindrical tubular structure that has an interior threaded portion at a first end, and an exterior surface area.

The exterior surface area has a plurality of flexible spike-like projections. The first tubular structure is rigid. The plurality of flexible spike-like projections are proportionately spaced linearly along the surface of the first tubular structure. Included is a second cylindrical tubular structure that has a rigid interior tube. The interior tube has an end cap at one end that is integral to the interior tube and the second tubular structure. The end cap has a central opening that leads into the interior tube. The second tubular structure has an outer surface and an inner surface. The second tubular structure has a chamber that is formed between the inner surface and the interior tube. The second cylindrical tubular structure has a plurality of rigid spike-like projections. The plurality of rigid spike-like projections have adjacent generally rectangular slots. The plurality of rigid spike-like projections and the slots are along an outer surface of the second cylindrical tubular structure. The rigid spike-like projections are proportionately spaced along the outer surface. The slots are proportionately spaced along the outer surface. The slots are spaced along a linearly extending axis that extends from the end cap through a number of the slots and their adjacent spike-like projections. Furthermore, the second cylindrical tubular structure is capable of receiving the first cylindrical tubular structure therein. The first cylindrical tubular structure is encased within the chamber of the second tubular structure, while the flexible spike-like projections extend through the slots. Lastly, a generally rigid twist knob with a threaded end portion and a gripping portion is included. The threaded end portion couples with the interior threaded portion of the first tubular structure to secure the first tubular structure within the second tubular structure. The gripping portion of the knob may be used to push and pull the first tubular structure within the second tubular structure. The knob, when used for moving the first tubular structure, allows movement of the flexible projections within the slots to lock strands of hair around the second tubular structure.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved self holding hair curler apparatus which has all of the advantages of the prior art hair rollers and none of the disadvantages.

It is another object of the present invention to provide a new and improved self holding hair curler apparatus which may be easily and efficiently manufactured and marketed.

It is further object of the present invention to provide a new and improved self holding hair curler apparatus which is of durable and reliable constructions.

An even further object of the present invention is to provide a new and improved self holding hair curler apparatus which is susceptible of a low cost of manufacture with regard to both materials and labor, and which accordingly is then susceptible of low prices of sale to the consuming public, thereby making such self holding hair curler apparatus economically available to the buying public.

Still yet another object of the present invention is to provide a new and improved self holding hair curler apparatus which provides in the apparatuses and methods of the prior art some of the advantages Thereof, while simultaneously overcoming some of the disadvantages normally associated therewith.

Even still another object of the present invention is to provide a self holding hair curler apparatus for an improved hair roller that has spike-like projections that extend therefrom, and further the spike-like projections are capable of pinching the hair to hold the invention in place.

Lastly, it is an object of the present invention to provide a new and improved self holding hair curler apparatus including a first structure that has an interior threaded portion at a first end and an exterior surface area with a plurality of flexible spike-like projections. Included is a second structure that has an interior tube with an end cap at one end that is integral. The end cap is integral the second structure at one end. The second structure has an inner surface and a chamber formed between the inner surface and the interior tube. The second structure has a plurality of rigid spike-like projections with adjacent slots along an outer surface thereof. Lastly, the second structure is capable of receiving the first structure within the chamber, while the flexible spike-like projections extend through the slots for movement to pinch strands of hair positioned about the second structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the self holding hair curler apparatus constructed in accordance with the principles of the present invention.

FIG. 2 is a fragmented view of the present invention showing the rigid slots and flexible slots as adjacent.

The same reference numerals refer to the same parts through the various Figures.

DESCRIPTION OF THE PREFERRED EMBODIMENT

Figure 3:
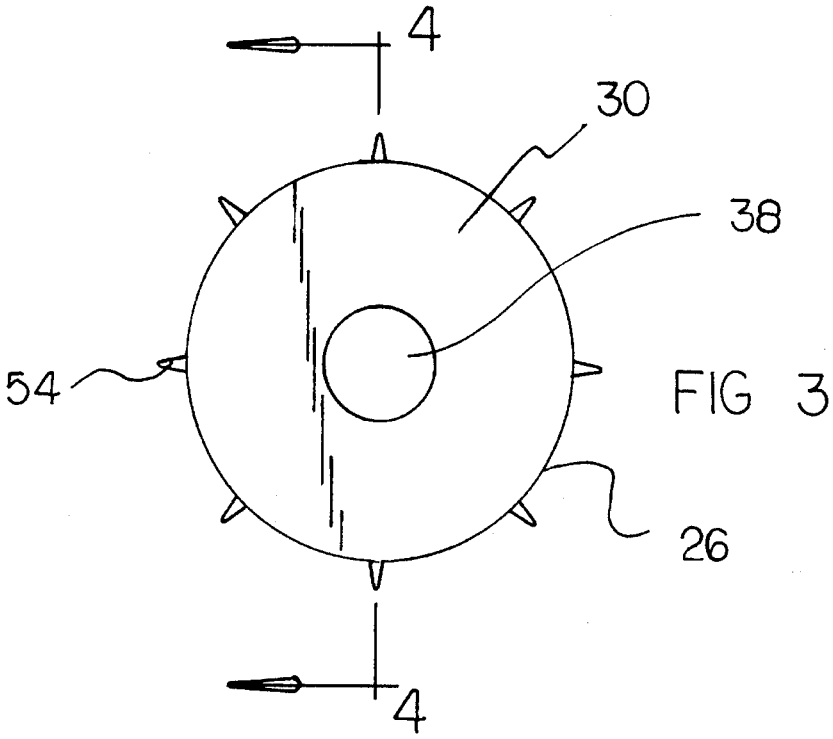
FIG. 3 is a rear view of the present invention as shown in FIG. 1.

With reference now to the drawings, and in particular to FIG. 1 thereof, the preferred embodiment of the new and improved self holding hair curler apparatus embodying the principles and concepts of the present invention and generally designated by the reference numeral 10 will be described.

The present invention, the self holding hair curler apparatus 10 is comprised of a plurality of components. Such components in their broadest context include a first tube, a second tube and a knob. Such components are individually configured and correlated with respect to each other so as to attain the desired objective.

Figure 5:
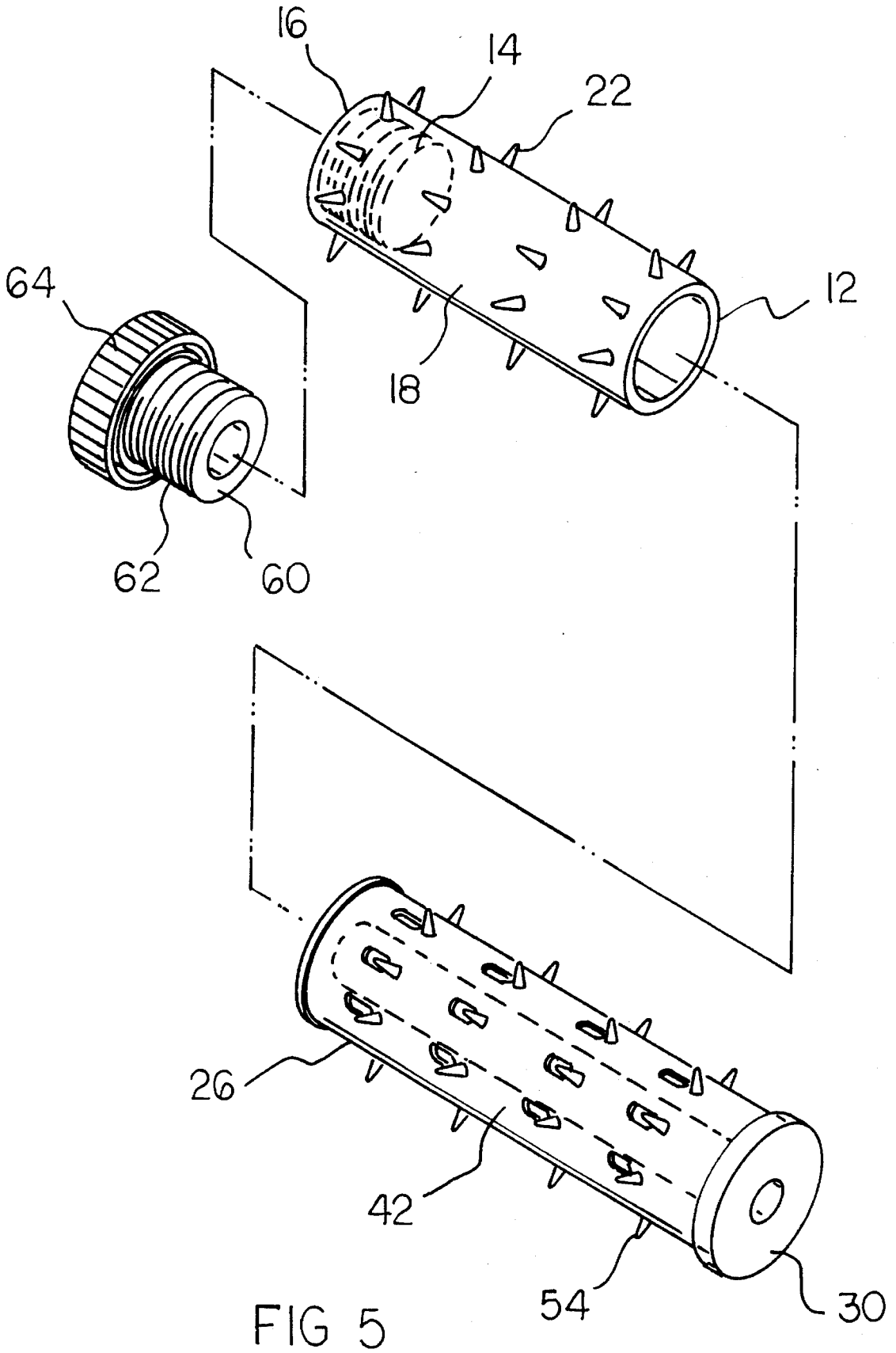
FIG. 5 is an exploded view of the present invention and its operable components.

Specifically, the present invention includes a first cylindrical tubular structure 12, as shown in FIG. 5. The first tubular structure has an interior threaded portion 14 at a first end 16, and an exterior surface area 18 with a plurality of flexible spike-like projections 22. The first tubular structure is rigid and preferably formed of a heat resistant plastic. The plurality of flexible spike-like projections are proportionately spaced linearly along the surface of the first tubular structure. The plurality of flexible spike-like projections also cover the exterior surface of the tubular structure along a circular orientation. The flexible spike-like projections are formed of a rubberized material. The flexible spike-like projections are formed onto the tubular structure during the molding process.

Figure 4:
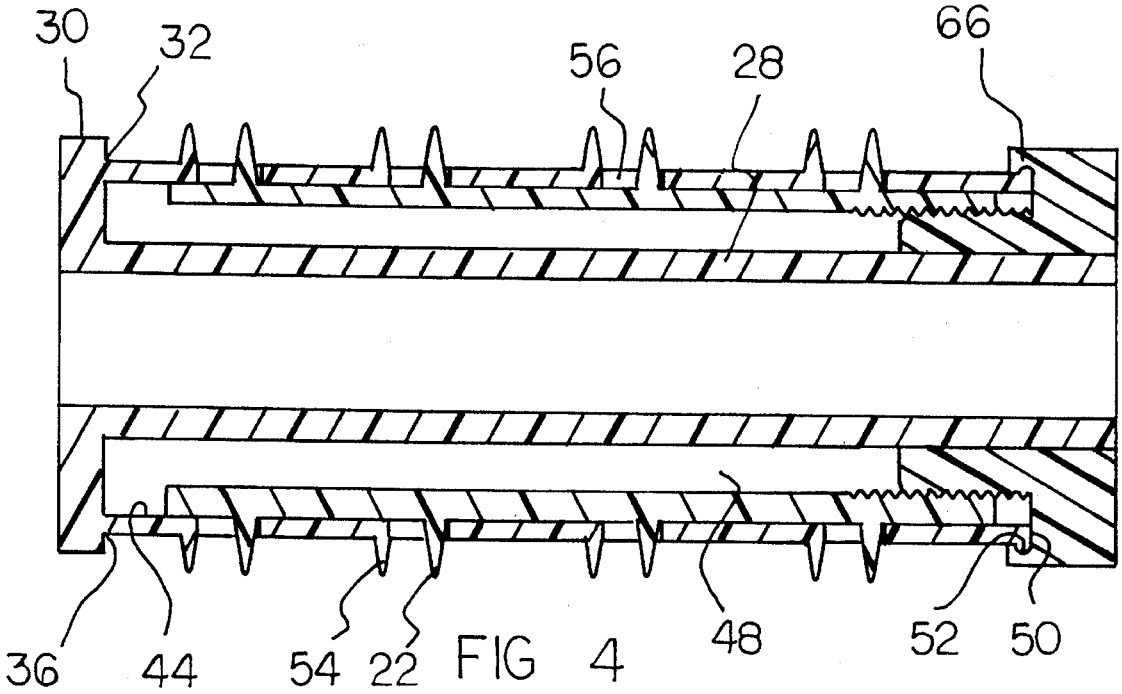
FIG. 4 is a cross sectional view of the invention of FIG. 1 taken along line 4—4 of FIG. 3.

Also, a second cylindrical tubular structure 26 is provided. The second tubular structure, as shown in FIG. 4, has a rigid interior tube 28. The interior tube has an end cap 30 at one end 32 that is integral thereto. The end cap, also, is integral the second tubular structure at one end 36. The second tubular structure, the end cap and the interior tube are formed of a rigid plastic. The three components of the second tubular structure are integral and may be formed by an injection process or thermoplastic molding process. The end cap has a central opening 38, as shown in FIG. 3, that leads into the interior tube, as shown in FIG. 4. The opening of the end cap is sized to receive standard heated stud, and allows the stud to be positioned within he interior tube. The second tubular structure has an outer surface 42 and an inner surface 44. The second tubular structure has a chamber 48 that is formed between the inner surface and the interior tube. The chamber extends the entire length of the second cylindrical tubular structure. The second tubular structure has another end 50 with a notch 52 as shown in FIG. 4. The notch projects slightly from the outer surface.

As best illustrated in FIG. 1, the second cylindrical tubular structure has a plurality of rigid spike-like projections 54, with adjacent generally rectangular slots 56, along the outer surface 42. The rigid spike-like projections are about one-fourth inch above the second tubular structure and are formed of the same plastic used to make the second tubular structure. The rigid spike-like projections are integral and proportionately spaced along the outer surface of the second tubular structure 26. The slots are proportionately spaced along the outer surface as shown in FIG. 2. The slots are spaced along a linearly extending axis that is capable of extending from the end cap 30 through a number of the slots 56 and their adjacent spike-like projections 54.

The second cylindrical tubular structure 26 receives the first cylindrical tubular structure 12 therein. The first cylindrical tubular structure is encased within the chamber 48 of the second tubular structure, while the flexible spike-like projections extend through the slots 56. The flexibility of the spike-like projections of the first tubular structure allow the first tubular structure to be slid into the chamber without breaking the projections.

Lastly, a generally rigid twist knob 60 is included. The knob, as shown in FIG. 5, has a threaded end portion 62 and a gripping portion 64. The threaded end portion couples with the interior threaded portion 14 of the first tubular structure, and secure the first tubular structure within the second tubular structure 26. When the two tubular structures are coupled, the heater stud can continue to be placed within the interior tubes. The gripping portion of the knob is used for pushing and pulling of the first tubular structure when it is positioned within the second tubular structure. When the knob is pushed, the flexible spike-like projections are placed adjacent the rigid spike-like projections. When the knob is pulled the flexible spike-like projections are placed away from the rigid spike-like projections. The movement of the flexible projections within the slots, lends to an opening and closing of the projections. Hair is rolled around the second tubular structure. The knob has a ridge 66 for snap fastening with the notch to secure the knob to the second tubular structure. The knob is used for moving the first tubular structure once an amount of hair has been rolled around the second structure. Moving the knob allows movement of the flexible spike-like projections within the slots to lock the hair strands around the second tubular structure.

The present invention is a self holding hair curler apparatus that eliminates the need for metal clips to secure the hair around the curler. This apparatus will save time and trouble, by not having to look for a clip of a particular size to secure the hair in the roller. The hair curler apparatus works just like a conventional hair curler. The hair is rolled up on the curler and is secured around the curler by the pushing in on the knob to cause the flexible spike-like projections to pinch the hair against the rigid spike-like projections. To release the hair around the curler, the knob is simply pulled and the curler falls out of the hair. The present invention is faster and easier than the conventional curlers. It eliminates the need for metal clips to hold the curler and the hair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved self holding hair curler apparatus for rolling sections of hair therearound comprising in combination:

a first cylindrical tubular structure having an interior threaded portion at a first end and an exterior surface area with a plurality of flexible spike-like projections, the first tubular structure being rigid, the plurality of flexible spike-like projections being proportionately spaced linearly along the surface of the first tubular structure;

a second cylindrical tubular structure having a rigid interior tube therein, the interior tube having an end cap at one end being integral thereto, the end cap having a central opening therein and leading into the interior tube, the second tubular structure further having an exterior tube with an outer surface and an inner surface, the second tubular structure having a chamber being formed between the inner surface and the interior tube;

the second cylindrical tubular structure having a plurality of rigid spike-like projections with adjacent generally rectangular slots along the outer surface thereof, the rigid spike-like projections being proportionally spaced along the outer surface of the second tubular structure, the slots being proportionally spaced along the outer surface, the slots being spaced along a linearly extending axis capable of extending from the end cap through a number of the slots and their adjacent spike-like projection;

the second cylindrical tubular structure being capable of receiving therein the first cylindrical tubular structure, the first cylindrical tubular structure capable of being encased within the chamber of the second tubular structure while the flexible spike-like projections extend through the slots; and a generally rigid twist knob having a threaded end portion and a gripping portion, the threaded end portion being capable of coupling with the interior threaded portion of the first tubular structure for secure the first tubular structure within the second tubular structure, the gripping portion of the knob being capable of being used for pushing and pulling of the first tubular structure when positioned within the second tubular structure, the knob being used for moving the first tubular structure whereby allowing movement of the flexible projections within the slots for locking strands of hair around the second tubular structure.

2. A self holding hair curler apparatus comprising:

a first structure having an interior threaded portion at a first end and an exterior surface area with a plurality of flexible spike-like projections;

a second structure having a interior tube therein with an end cap at one end being integral thereto, the second structure further having an exterior tube with an inner surface and a chamber being formed between the inner surface and the interior tube, the second structure having a plurality of rigid spike-like projections with adjacent slots along an outer surface thereof; and the second structure being capable of receiving therein the first structure within the chamber thereof, while the flexible spike-like projections extend through the slots for movement to pinch strands of hair positioned about the second structure.

3. The self holding hair curler apparatus as set forth in claim 2 wherein the first structure is a rigid cylindrical tubular structure with the plurality of flexible spike-like projections being proportionately spaced linearly along the surface of the first tubular structure.

4. The self holding hair curler apparatus as set forth in claim 3 wherein the second structure is a rigid cylindrical tubular structure with the end cap having a central opening therein and leading into the interior tube, and the interior tube being capable of receiving a stud heater therein.

5. The self holding hair curler apparatus as set forth in claim 4 wherein the first cylindrical tubular structure is encased within the chamber of the second tubular structure, while a generally rigid twist knob secures the first tubular structure within the second tubular structure.

6. The self holding hair curler apparatus as set forth in claim 5 wherein the rigid twist knob has a threaded end portion and a gripping portion, the threaded end portion being capable of coupling with the interior threaded portion of the first tubular structure, the gripping portion of the knob being capable of being used for pushing and pulling of the first tubular structure when positioned within the second tubular structure whereby allowing the flexible projections within the slots for locking strands of hair around the second tubular structure.

7. The self holding hair curler apparatus as set forth in claim 2 wherein the slots is proportionally spaced along the outer surface, and spaced along a linearly extending axis capable of extending from the end cap through a number of the slots and their adjacent spike-like projection.

* * * * *